United States Patent [19]

Wirtgen

[11] Patent Number: 4,678,236

[45] Date of Patent: Jul. 7, 1987

[54] APPARATUS FOR WORKING DEPOSITS BY THE OPEN-CAST WORKING PROCESS

[76] Inventor: Reinhard Wirtgen, Hohner Strasse 2, D-5461 Windhagen, Fed. Rep. of Germany

[21] Appl. No.: 824,251

[22] Filed: Jan. 30, 1986

[30] Foreign Application Priority Data

Feb. 11, 1985 [DE] Fed. Rep. of Germany ..... 3504610
Feb. 11, 1985 [DE] Fed. Rep. of Germany ..... 3504611

[51] Int. Cl.[4] ..... E21C 47/02

[52] U.S. Cl. ..... 299/1; 299/39; 37/DIG. 1

[58] Field of Search ..... 299/1, 36, 39; 37/DIG. 1, DIG. 19

[56] References Cited

U.S. PATENT DOCUMENTS

| | | | |
|---|---|---|---|
| 3,000,121 | 9/1961 | Martin et al. | 37/DIG. 1 X |
| 3,888,542 | 6/1975 | Gowler | 299/1 |
| 3,929,377 | 12/1975 | Weaver et al. | 299/1 |
| 4,262,964 | 4/1981 | Ingle et al. | 299/1 |

FOREIGN PATENT DOCUMENTS

| | | | |
|---|---|---|---|
| 2159044 | 6/1973 | Fed. Rep. of Germany | 299/39 |
| 2714357 | 11/1977 | Fed. Rep. of Germany | 299/1 |

*Primary Examiner*—Stephen J. Novosad
*Assistant Examiner*—Michael A. Goodwin
*Attorney, Agent, or Firm*—Steinberg & Raskin

[57] ABSTRACT

The invention relates to an apparatus for working deposits by the open-cast working process with a self-propelled chassis, with a cutting cylinder mounted vertically adjustably thereon to cut away the deposit to a given depth, and with a loading apparatus for the material cut away, in which one or more photosensors I and II are provided at the height of the cut-away surface of the deposit, which react to the light reflected by the deposit and contact the vertical adjustment of the cutting cylinder. The sensors preferably consist of a phototransmitter and a photoreceiver which are arranged juxtaposed and preferably operate with a light wavelength in the infra-red range.

The invention further relates to the special photosensor arrangement in which the photosensor is arranged in, and at a distance from the lower end of a hollow element open at the bottom, arranged preferably vertically behind the cutting cylinder, and a compressed air supply is provided preferably in the upper part of the hollow element, whereby dust and dirt are kept away from the photosensor.

20 Claims, 10 Drawing Figures

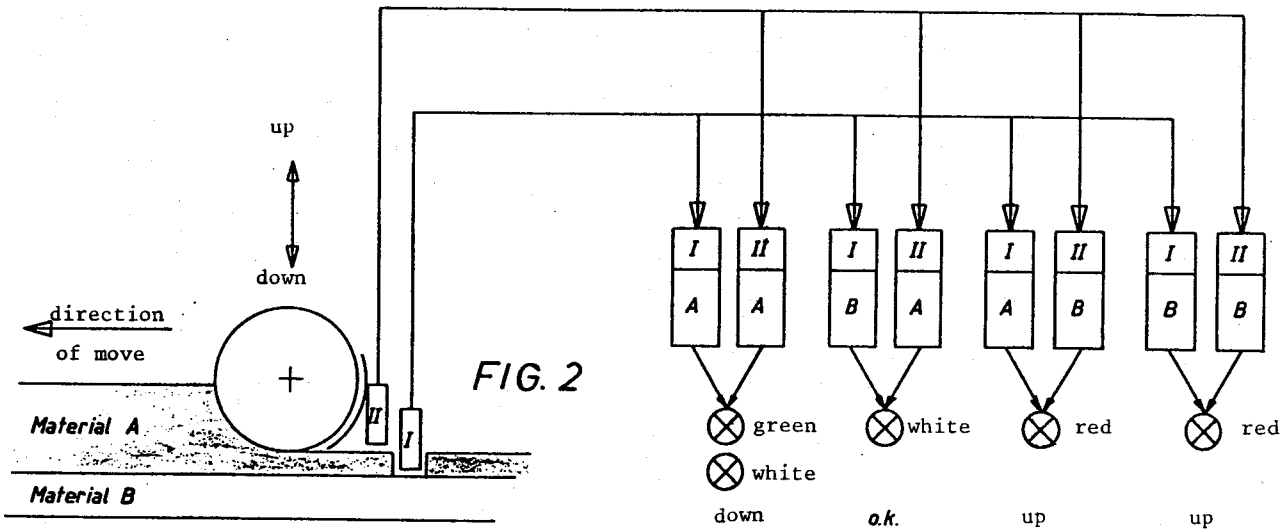
FIG. 2
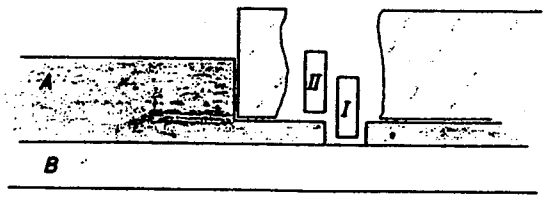
FIG. 3
| Function recogn. B | | | | Funct. recogn. A | |
|---|---|---|---|---|---|
| I | II | Funct. | Lamp | Funct. | Lamp |
| A | A | down | gr +wh | up | red |
| B | A | stop | white | up | red |
| A | B | up | red | stop | white |
| B | B | up | red | down | gr+whi. |
FIG. 4

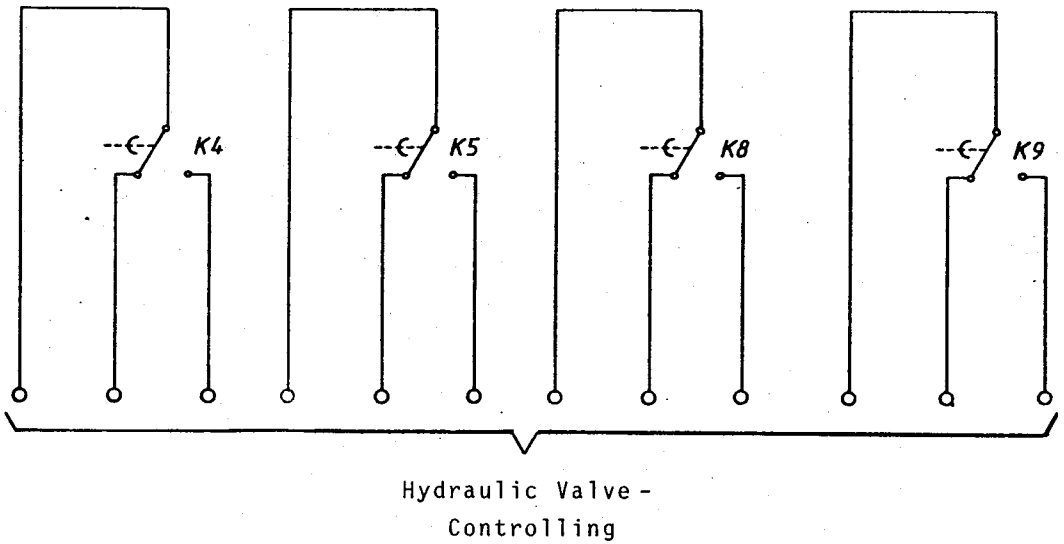
FIG. 6
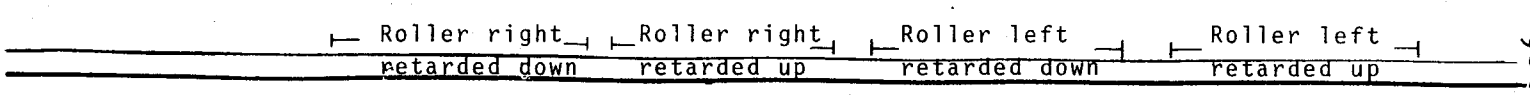

APPARATUS FOR WORKING DEPOSITS BY THE OPEN-CAST WORKING PROCESS

BACKGROUND OF THE INVENTION

Deposits of minerals, ores, salts, brown coal and also pit coal are generally very extensive, and in cases where they are located not too deep below the earth's surface it is customary, for cost reasons, to work these deposits by open-cast working, even if relatively thick topsoil has to be removed previously in order to reach the actual deposit.

In Australia and also in South Africa, for example, enormous coal deposits are present close beneath the earth's surface, extending over many square kilometers.

So-called "Surface Miners" have been developed for working these deposits. These are apparatuses with a self-propelled chassis, with a cutting cylinder mounted with vertical adjustability thereon for cutting away the deposit to a specific depth, and with a loading apparatus for the material cut away.

These machines travel across the deposit and cut the deposit material away to a specific depth and simultaneously load the material, which is produced in comminuted form, by means of the loading apparatus onto transport vehicles which travel at the same speed behind or beside the apparatus and thus ensure continuous transport away.

Although the deposits frequently exhibit a relatively great thickness of the strata, nevertheless these strata do not always extend precisely parallel to the surface. Distortions and shifts in the earth's crust in the course of thousands of years have on the contrary caused the deposits which are to be worked to disappear in the earth's surface again at certain points and then suddenly come to light once more.

Furthermore, the mineral or coal strata to be worked frequently alternate with barren topsoils, which has the consequence that in the case of the open-cast working process by means of the "Surface Miners" mentioned above, not only the required deposit material, coal for example, but also frequently barren rock is transported. Even when the working apparatus is still definitely traveling over coal or mineral strata, it may nevertheless occur that the thickness of these strata at certain points does not correspond to the cutting depth, so that only a fraction of the material produced is actually coal or another required deposit material, and a large quantity of barren rock is produced additionally because the cutting cylinder of the working apparatus has cut too deep at certain points.

This proves an extraordinary disadvantage in practice, because the material thus produced by the "Surface Miners" must be separated again from the barren rock.

SUMMARY OF THE INVENTION

The object of the present invention is to overcome this disadvantage and to provide a "Surface Miner" with which the quality of the deposit material which is worked is substantially improved.

The principle of the invention is based upon distinguishing between the various deposit materials on the basis of their different reflectivity for visible light or for light of a selected wavelength, light in the infra-red range for example.

The object according to the invention is accordingly achieved with an apparatus of the type defined initially, wherein one or more photosensors, which are provided at the height of the deposit surface cut away, react to the light reflected by the deposit and control the vertical setting of the cutting cylinder.

It is possible to use as a photosensor, in the simplest case, a simple photocell which measures the light reflected by the surface cut away. So long as the cutting cylinder is working in coal and the surface cut away still shows black coal, the photocurrent generated by the weak light reflected by the black coal is very weak, whereas, on the other hand, when the coal stratum finishes and a relatively light clay layer appears, substantially more light is reflected by this clay layer. A correspondingly strong photocurrent is thereby generated in the photocell, and in turn triggers a signal in the simplest case, or else directly and automatically modifies the vertical setting of the cutting cylinder until the surface exposed during the cutting process consists of coal again, which is indicated by the relatively small quantity of light reflected by the surface end the relatively weak photocurrent thereby generated.

Because, in the case of a relatively simple photosensor apparatus constructed in such a way, the photocurrent measured is influenced by the daylight intensity, and recognition of the different materials is impossible in darkness, according to an advantageous embodiment of the present invention it has been found convenient for the photosensor or photosensors to consist in each case of a phototransmitter and a photoreceiver which are arranged juxtaposed.

With a sensor unit constructed in this manner, one is largely independent of the ambient illumination, so that even in darkness the deposit material can be recognised without difficulty on the basis of the reflected light.

The phototransmitter and the photoreceiver are conveniently arranged in the same housing, whereby the assembly is substantially facilitated.

Because the path of the light from the phototransmitter to the deposit material and back again to the receiver is relatively short, it is possible to operate with relatively high light intensities, as a result of which differences in the daylight intensity largely have no influence upon the reflected light.

This influence of the daylight intensity is however eliminated still further if, according to another advantageous embodiment of the present invention, the photosensor or photosensors operate with selected light frequencies, preferably with infra-red light.

In such an advantageous embodiment of the invention the phototransmitter transmits infra-red light of a specific wavelength, which is then reflected from the deposit material and received by the photoreceiver, and transformed into a corresponding electric current, which in turn, after appropriate amplification, controls the vertical adjustment of the cutting cylinder.

According to a particularly advantageous embodiment of the present invention, at least two sensors comprising phototransmitter and photoreceiver and arranged mutually juxtaposed are provided, one of which is directed towards a surface region located a few centimeters (i.e. one or more centimeters) below the cut-away surface of the deposit. This deeper-lying surface region is obtained by drawing a correspondingly wide furrow with a special tool below the customary cutting level.

With such a sensor combination it is possible to control the cutting depth of the cutting cylinder so that it follows accurately the dividing line between two differently reflecting materials, the dark coal stratum and the light clay stratum located beneath it, for example, and cuts away only the coal stratum. The distance between the two sensors, which may be 1.5 to 2 centimeters, for example, represents the tolerance range for the cutting and it is utilised for the upward and downward regulation of the cylinder. Upon the command "cylinder down" the cutting cylinder descends until the sensor I, which is arranged below the cutting line, meets the lower material (clay for example) which is to be separated from the upper material (coal for example). The downward movement of the cutting cylinder is stopped by this means and the cylinder cuts along this dividing line. The sensor II, which is adjusted to cutting level, monitors that the cylinder is still in the upper material (coal). If the lower material rises suddenly, then the sensor II reacts and causes the cylinder to be raised automatically until the sensor II indicates coal once more.

According to a further advantageous embodiment of the present invention, two sensors comprising phototransmitter and photoreceiver and arranged mutually juxtaposed are provided on each side of the cutting cylinder, of which one in each case is directed towards a surface region located a few centimeters (e.g., one or more centimeters) below the surface of the deposit surface cut away, the sensors of each side controlling the lift cylinder of the associated side of the cutting cylinder. As to this it should be observed that the cutting cylinder is customarily supported on each side by a lift cylinder, via which a lateral inclination of the cylinder can be set.

Therefore if the configuration of the strata varies across the width of the cutting cylinder, this can be compensated by corresponding lateral inclination of the cutting cylinder, the sensors of each side modulating correspondingly the lift cylinder provided on the respective side for the vertical setting of the cutting cylinder.

Because the apparatus according to the invention reacts directly to variations in the reflected light received by the sensors and causes a corresponding correction of the cutting cylinder setting, but on the other hand the strata to be cut away are frequently contaminated with materials which give a different light reflection, according to a further advantageous embodiment of the present invention it has been found convenient for a time delay element to be provided in the control circuit of each photoreceiver, by which the reaction time can be adjusted differently according to local conditions if appropriate.

In this manner it is achieved that, for example, light-colored rock fragments embedded in the coal stratum do not immediately cause a variation in the cutting depth, but such a cutting depth variation is caused only when the lower-placed sensor reports a change of material over a major cutting distance.

Such a time delay may per se be achieved in any desired known manner. However this will, for the sake of simplicity, conveniently be effected by an electric time delay element provided in the circuit.

In this manner a modification of the time delay is also possible without difficulty in order to take into consideration the relevant local conditions.

The invention further relates to a special photosensor arrangement for the control of the cutting depth setting of the Surface Miner discussed above.

Photosensors of this type, which either consist of a simple photocell and measure the light reflected by the surface of the deposit surface cut away, or else consist of a phototransmitter and a photoreceiver arranged directly beside the latter or even in the same subassembly and which operate either with normal light or preferably with light of a special wavelength, with infra-red light by special preference, are arranged directly behind the cutting cylinder, that is to say in a region which is much threatened and, above all, exhibits an intense evolution of dust and dirt.

The sensors are therefore subject to very intense fouling in practical operation, which in turn means that the reference values once set are no lohger relevant after a certain time, and faulty measurements and faulty control operations of the cutting cylinder consequently occur.

It is a further aim of the present invention to overcome these disadvantages and to construct and arrange the photosensors so that fouling is largely prevented.

An additional object, in the case of the use of two sensors which sense deposit surfaces of different depths, is to arrange the lower-placed sensor so that it correctly senses the deposit surface in a plane located by a definite amount below the cutting plane.

The first-mentioned object is achieved with a photosensor arrangement of the type defined above, wherein the photosensor is arranged in a hollow element which is preferably arranged vertically behind the cutting cylinder and open at the bottom, at a distance from the lower end of the said element.

Such a hollow element, which may per se exhibit any desired cross-section, preferably has a circular cross-section and may be constructed and arranged so stably that even relatively large fragments of the material cut away, when they strike it, do not damage the sensor arranged in its interior at a distance from its lower end.

It has also been found convenient in this case to arrange the photosensor at a distance from the wall of the hollow element, for example so that the sensor is attached to the closed end of the hollow element by a support means guided parallel to the wall of the hollow element.

In the case of such a construction, shocks against the hollow element are transmitted only indirectly to the relatively sensitive sensor.

Whereas in this manner the sensor is arranged largely protected from direct influences by the material cut away, the evolution of dust and dirt during cutting nevertheless proves extraordinarily disadvantageous. The fine dust particles also penetrate into the hollow element and settle on the internal wall and particularly on the sensor window and thus impair the measurement results.

According to a particularly advantageous embodiment of the present invention, this disadvantage is overcome when a compressed air feed line is provided in the upper part of the hollow element. Compressed air is blown permanently through this compressed air feed line into the hollow element, whereby the penetration of dust and dirt particles into the hollow element is largely prevented.

It has also been found particularly convenient if, instead of the introduction of the compressed air in the upper part of the hollow element, or in addition to the introduction of the compressed air in the upper part of the hollow element, a lateral compressed air supply is provided at the height of the photosensor. The sensor window specifically is constantly blown clear by this lateral compressed air supply.

If a hollow element of approximately circular cross-section is adopted, it has been found highly convenient to introduce the compressed air feed line tangentially into the hollow element. One or preferably a plurality of such tangential compressed air feeds keep both the internal wall of the hollow element and also the sensor window largely free of fouling, so that faulty control operations of the cutting depth setting are prevent even during prolonged long-term operation of the apparatus.

The lateral compressed air supply is preferably positioned in the interior of the hollow element, so that it is arranged protected from external influences.

However, because the hollow element itself must be of extremely thick-walled construction, in order that it exhibits the required stability, it has been found highly convenient to provide in the wall of the hollow element one or more holes in the axial direction, through which the compressed air is passed approximately to the height of the sensor window and then exits inwards through a transverse hole which is preferably made tangentially.

In this manner the compressed air supply in the hollow element can be realized in a relatively simple manner, without compressed air lines impairing the cleaning airstream in the interior of the hollow element.

As already mentioned initially, the control of the cutting depth setting of the cutting cylinder is frequently effected with two sensors, of which one sensor unit senses the normal cut-away surface of the deposit, while the second sensor unit senses a surface located somewhat lower.

It is necessary to provide for this purpose a mechanical scarifying apparatus, with which the deposit surface already cut away is scarified to a small extent, in order that the deposit located beneath it can be sensed by the sensor or, more accurately, the reflected light of this surface can be received by the sensor and transformed into electrical energy in order to serve to set the cutting depth of the cutting cylinder. The making of such a lower-lying trench presents some problems.

The applicant has discovered in extensive experiments that optimum results with regard to the making of such a lower-lying trench are achieved by the provision of a small cutting cylinder which cuts open the deposit surface already cut away, to the width necessary for the sensor, and thus creates the possibility of testing the materials lying beneath that surface as regards their light-reflecting characteristics.

According to another advantageous embodiment the lower-lying sensor is arranged behind a small plow share which scarifies the cut-away deposit surface to the required depth.

According to an embodiment of the present invention which is particularly simple to realize, the lower-lying sensor is arranged behind a cutting blade standing vertically on the customary cutting cylinder, which blade scarifies the deposit surface to the required depth. Auxiliary apparatuses for the making of the "measurement trench" are, as it were, made superfluous by this embodiment. It is merely convenient to provide at the corresponding point of the scraper plate a further projecting region which clears the trench cut by the upright cutting blade of the loose material, so that the sensor can test the lower-lying surface of the trench as regards its light-reflecting characteristics.

BRIEF DESCRIPTION OF THE DRAWINGS

The invention is explained more fully in detail below with reference to the exemplary embodiments illustrated in the accompanying drawings. In the drawings:

FIG. 2 shows a diagrammatic view of the cutting cylinder in the coal stratum to be cut away and the arrangement of the sensors I and II;

FIG. 3 shows a diagrammatic view of a planing cutter instead of the cutting cylinder according to FIG. 2 in the coal stratum to be cut away and the arrangement of the sensors I and II;

FIG. 4 shows a diagram of the cylinder functions depending on the detection by the sensors I and II according to the circuit diagram illustrated in FIG. 2;

FIG. 6 illustrates diagrammatically the hydraulic valve modulation system;

DESCRIPTION OF THE PREFERRED EMBODIMENTS

Figure 1:
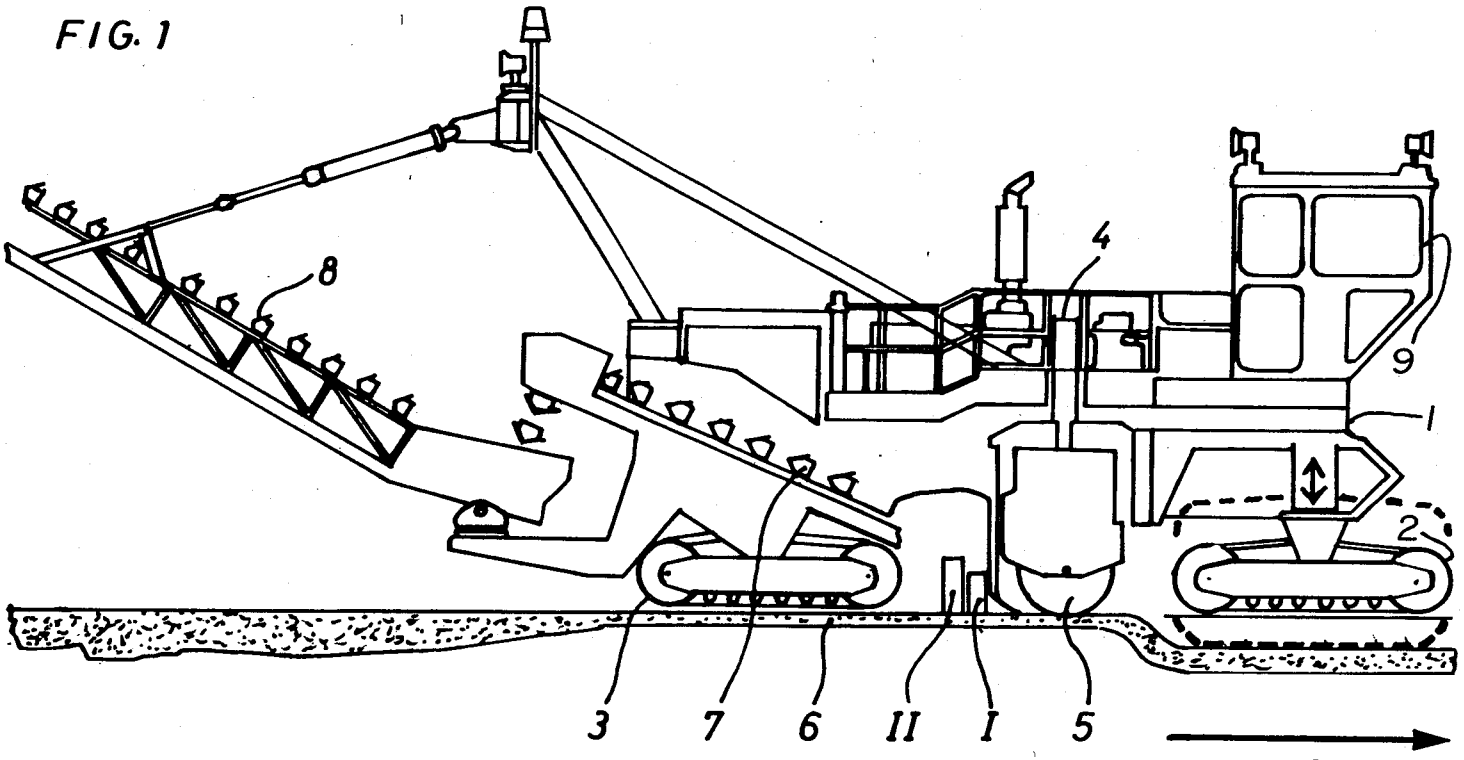
FIG. 1 shows an apparatus according to the invention for working deposits by the open-case working process in a diagrammatic view.

The apparatus according to the invention, illustrated in FIG. 1, for working deposits by the opencast working process consists of a self-propelled chassis 1 with steerable and vertically adjustable caterpillar-tracked chassis 2 at the front end and two caterpillar-tracked chassis 3 arranged juxtaposed at the rear end. A cutting cylinder 5, which is arranged with vertical adjustability via two hydraulic cylinders 4 between the chassis, cuts away the deposit 6 to a predetermined depth, and depending upon the direction of rotation of the cutting cylinder 5, the material cut away either accumulates directly behind the cutting cylinder or, if the cutting cylinder rotates counter to the direction of travel, accumulates in front of the cutting cylinder and is then transported backwards over the cutting cylinder. The material cut away passes from there by means of a conveyor belt 7 onto a further loading belt 8 and is loaded from there onto a transport vehicle which follows the working apparatus.

The central control unit is accommodated in the driver's cab 9.

The control of the cutting cylinder 5 is effected by two sensors I and II arranged on each side of the cutting cylinder behind the cutting cylinder considered in the direction of travel, which sense the deposit cut away. The sensor I is arranged behind a special scarifying unit (e.g., FIG. 8) so that it senses the surface of the deposit approximately 2 centimeters below the cutting level, while the sensor II senses the surface of the deposit at the height of the cutting level.

Depending upon the light signals received during sensing, the sensors I and II, which are arranged on each side of the cutting cylinder 5, control the lift cylinder 4 of the cutting cylinder provided on each side and hence the vertical adjustment of the cutting cylinder.

FIGS. 2 and 4 show how the cutting cylinder is adjusted as a function of the light signals received in the sensors I and II.

FIG. 3 illustrates diagrammatically the possibility of using, instead of the cutting cylinder 5, a stripping blade 10, the vertical adjustment of which, and hence the thickness of the material stripped off, is likewise effected by the sensors I and II in conformity with the scheme illustrated in FIGS. 2 and 4.

Figure 5A:
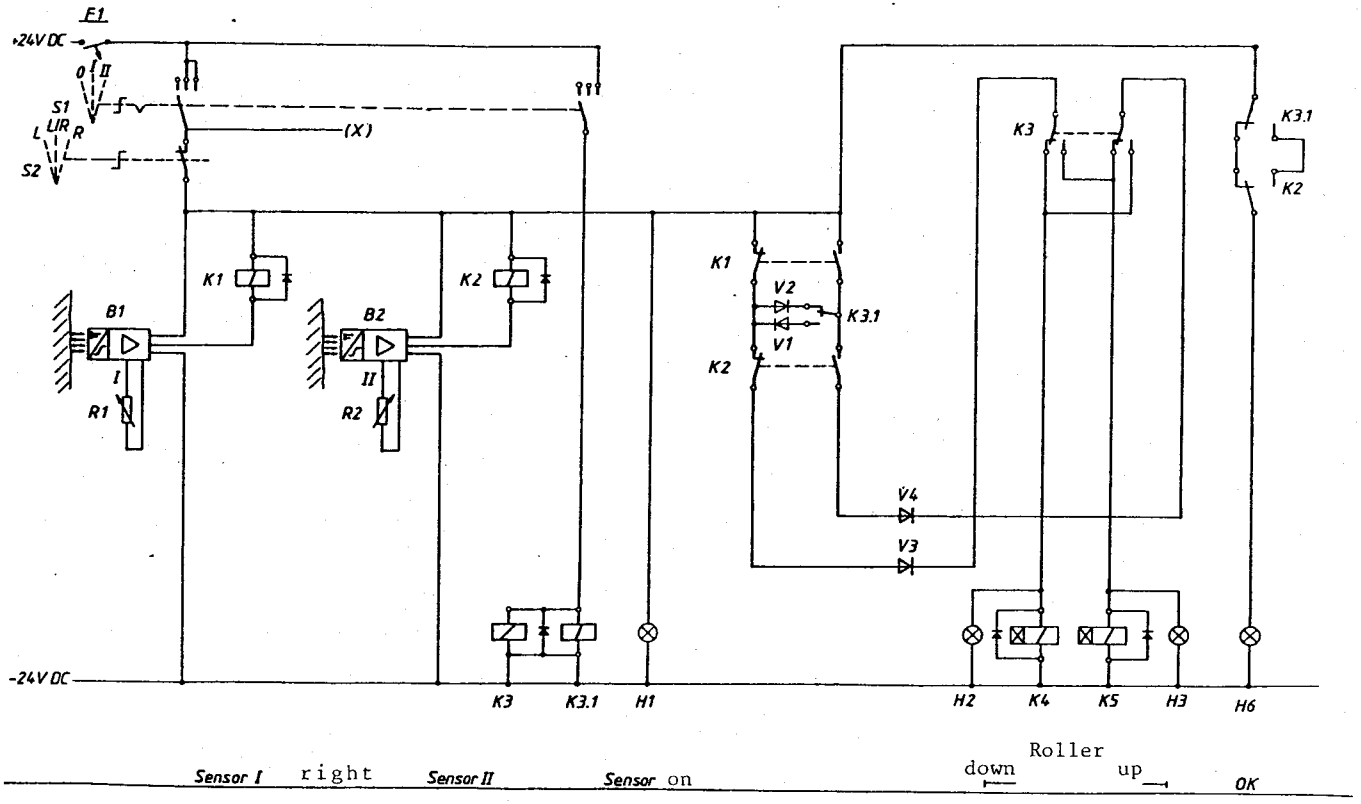
FIGS. 5*a* and 5*b* show conjointly the circuit diagram for the cutting depth control of the apparatus according to the invention.
Figure 5B:
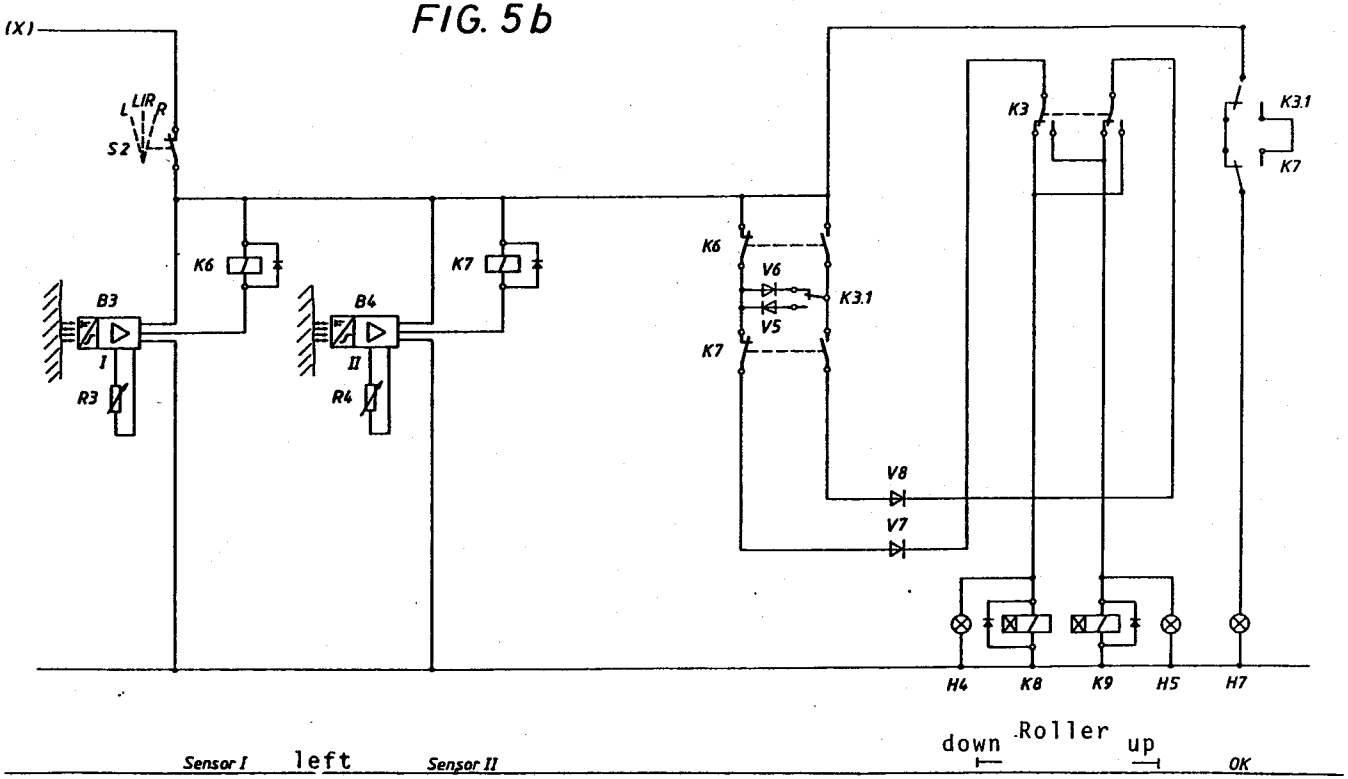

In the circuit for setting the cutting depth of the cutting cylinder 5 illustrated in FIGS. 5*a* and 5*b*, two sensors I and II are fitted on each side of the cutting cylinder 5 behind the cutting cylinder. (See FIGS. 1 and 2.)

The switch S1 serves to switch on the installation and to preselect the function: Switch position I "Detection B" or switch position II "Detection A".

With the switch position II "Detection A" the function of Detection B is inverted, and the installation acquires a reverse switching behaviour. (See FIG. 4.) A corresponding interconnection is effected via the contacts of the relays K3 and K3.1.

The selector switch S2 permits the preselection: Sensor "Right on", "Left on", "Right and left on".

After the installation has been switched on, the sensors are supplied with the 24 v dc service voltage in accordance with the preselection S1 and S2.

The outputs of the sensors B1–B4 pass to the relays K1, K2, K6 and K7 and control the latter in the case of a corresponding detection of material. The sensitivity of the sensors is adjusted from the driver's cab 9 via the remote adjusters R1–R4 to correspond to the reflectivity of the material.

The sensor signals are interconnected via the contacts of the relays K1 and K2, or K6 and K7, respectively and guides V1 and V2, or V5 and V6, respectively (current path 6 and 7) in accordance with the table of FIG. 4 into control signals "Up", "Down" and "Stop" for the hydraulic control of the valves.

The "Up" and "Down" signals are delayed by time relays, so that only appropriately great changes in material in the last analysis trigger a modification of the vertical setting of the cutting cylinder.

Light emitting diodes H2, H3, H6 and H4, H5, H7, which are modulated in parallel with the control functions, light up in different colours in the driver's cab, according to the function. It is thus possible to control the cutting depth manually in correspondence with the indication of these light emitting diodes.

The contact outputs of the time relays K4, K5 and K8, K9 may be interconnected to conform to the requirements for each specific case of application.

Figure 7:
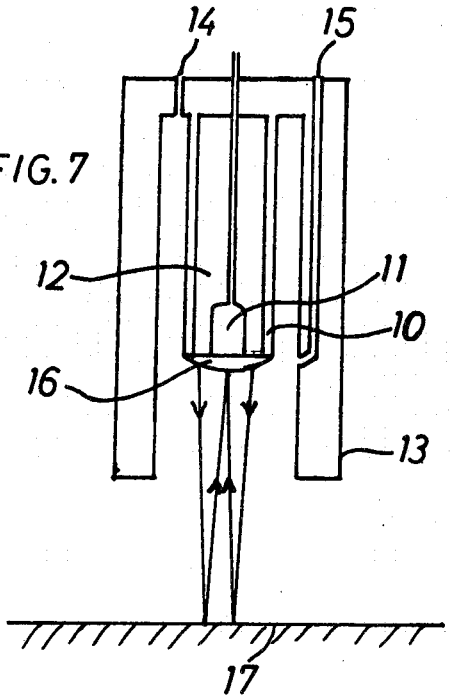
FIG. 7 shows a sensor arrangement according to the invention in section.

The sensor 10 illustrated in FIG. 7 consists of a photoreceiver 11 and a phototransmitter 12 surrounding the receiver 11, both of which are arranged in one housing. This sensor 10 is arranged in a hollow element 13, the sensor being attached at the closed end of the hollow element at a distance from the wall of the hollow element 13. A compressed air supply 14, by which compressed air is blown into the hollow element, is present in the closed end of the hollow element. The said supply has a pressure of approximately 2 atmospheres excess pressure and it ensures that dust and dirt do not settle either on the sensor, and particularly the sensor window, or on the interior wall of the hollow element.

A hole 15 extending in the axial direction, which is also provided in the relatively thick wall of the hollow element 13, terminates inside the hollow element 13 at the height of the sensor window 16, and compressed air which is likewise passed through this hole constantly blows the sensor window 16, in particular, clear.

The compressed air exiting downwards from the hollow element further ensures that any rock strata or clay strata are also blown clear of any black coaldust present, which might falsify the light reflection.

Infra-red light is preferably used for the measurement process, being emitted from the infra-red radiator 12 provided in the sensor, reflected by the deposit surface 17 and received by the receiver 11 and converted into electric signals which are used to control the cutting cylinder setting.

Figure 8:
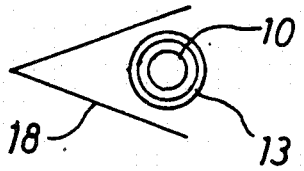
FIG. 8 shows the arrangement of a sensor behind a plowshare scarifying to the required depth the deposit cut away.

FIG. 8 shows the arrangement of the hollow element 13 with the sensor 10 arranged therein behind a plowshare 18, by which the deposit already cut away is scarified to the required depth so that the sensor can sense a lower-lying surface. FIG. 8 is a horizontal section of this.

Figure 9:
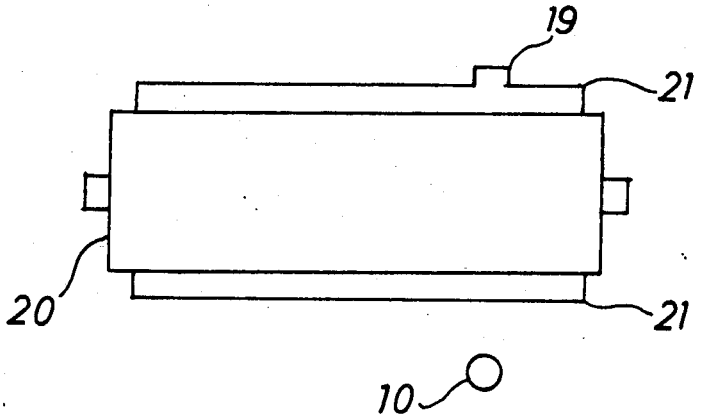
FIG. 9 shows the arrangement of the sensor behind a cutting blade mounted upright on the cutting cylinder, which scarifies the deposit to the required depth.

FIG. 9 illustrates diagrammatically a cutting cylinder 20, on which a single cutting blade 19 protrudes beyond the cutting range 21 of the other cutting blades and thus scarifies the surface of the deposit to the required depth. The sensor is arranged in alignment with this upright cutting blade 19, so that the light rays emitted from the sensor sense a lower-lying surface of the deposit, after the removal of the loose material if appropriate.

I claim:

1. Apparatus for working deposits by the opencast working process, with a self-propelled chasis, with a cutting implement mounted with vertical adjustability thereon for cutting away the deposit to a specific depth, and with a loading apparatus for the material cut away, wherein one or more photosensors, which are provided at the height of the deposit cut away, react to the light reflected by the deposit and control the vertical setting of the cutting implement.

2. Apparatus as claimed in claim 1, wherein the photosensor or photosensors comprise a phototransmitter and a photoreceiver which are arranged in juxtaposed position.

3. Apparatus as claimed in claim 2, wherein the phototransmitter and the photoreceiver are arranged in the same housing.

4. Apparatus as claimed in claim 2, wherein the phototransmitter and the photoreceiver operate with a selected light frequency.

5. Apparatus as claimed in claim 4, wherein the phototransmitter and the photoreceiver operate with a light wavelength in the infra-red range.

6. Apparatus as claimed in claim 1, wherein at least two sensors comprising a phototransmitter and photoreceiver and arranged in mutually juxtaposed position are provided, one of which is directed towards a surface region located 1 or more centimers below a cut-away surface of the deposit.

7. Apparatus as claimed in claim 6, wherein the cutting implement is a cylinder, and two sensors comprising a phototransmitter and photoreceiver and arranged in mutually juxtaposed position are provided on each side of the cutting cylinder, one of which in each case is directed towards a surface region located one or more centimeters below the cut-away surface of the deposit, the sensors of each side controlling a lift cylinder of the associated side of the cutting cylinder.

8. Apparatus as claimed in claim 1, wherein a time delay element is provided in the control circuit of each photoreceiver.

9. Photosensor arrangemeent for the control of the cutting depth of a surface mining apparpatus as claimed in claim 1, wherein the cutting implement is a cylinder, and the photosensor is arranged in a hollow element arranged behind the cutting cylinder, at a distance from the lower end of said hollow element.

10. Photosensor arrangement as claimed in claim 9, wherein the photosensor is arranged at a distance from the wall of the hollow element.

11. Photosensor arrangement as claimed in claim 9, wherein a compressed air supply is provided in the upper part of the hollow element.

12. Photosensor arrangement as claimed in claim 9, wherein a lateral compressed air supply is provided at the height of a sensor window.

13. Photosensor arrangement as claimed in claim 12, wherein the hollow element has an approximately circular cross-section and the compressed air supply is introduced tangentially into the hollow element.

14. Photosensor arrangement as claimed in claim 13, wherein two or more compressed air supplies are provided and distributed around the circumference of the hollow element.

15. Photosensor arrangement as claimed in claim 12, wherein one or more holes extending in the axial direction, which are provided in the wall of the hollow element for the passage of the compressed air, lead into the interior space of the hollow element at the height of the sensor

16. Apparatus as claimed in claim 8, wherein the cutting implement is a small cylinder, and at least one sensor unit comprising two sensors arranged mutually adjacent is provided, one of which being directed towards a region located a few centimeters below the cut-away surface of the deposit and which is also arranged behind the cutting cylinder cutting a trench.

17. Apparatus as claimed in claim 8, wherein the cutting implement is a plowshare, and comprising two sensors, one of which is a deeper - sensing sensor arranged behind the plowshare which scarifices to the required depth the deposit cut away.

18. Apparatus as claimed in claim 16, wherein one of said two sensors is a deeper-sensing sensor arranged behind a cutting blade standing upright on the cutting cylinder, which scarifices the surface of the deposit to the required depth.

19. The arrangement of claim 9, wherein the hollow element is arranged substantially vertically behind the cutting cylinder.

20. The arrangement of claim 15, wherein said at least one hole leads substantially tangentially into the interior space of the hollow element.

* * * * *